United States Patent [19]

Troncoso

[11] Patent Number: 4,542,732

[45] Date of Patent: Sep. 24, 1985

[54] COMPOUND ARCHERY BOW ASSEMBLY

[76] Inventor: Vincent F. Troncoso, 14090-6100 Rd., Montrose, Colo. 81401

[21] Appl. No.: 627,203

[22] Filed: Jul. 2, 1984

[51] Int. Cl.[4] ..... F41B 5/00

[52] U.S. Cl. ..... 124/24 R; 124/90

[58] Field of Search ..... 124/23 R, 24 R, 90, 124/86, 88, DIG. 1

[56] References Cited

U.S. PATENT DOCUMENTS

| | | | |
|---|---|---|---|
| 4,061,107 | 12/1977 | Smith | 124/88 X |
| 4,183,346 | 1/1980 | Troncoso | 124/88 X |
| 4,368,719 | 1/1983 | Christopher | 124/DIG. 1 |

OTHER PUBLICATIONS

"Trim-Line"-Archery Magazine, Jun. 1979, p. 4.
Hunter-Bow and Arrow Magazine, Oct. 1982, p. 10.

*Primary Examiner*—Richard J. Apley
*Assistant Examiner*—William R. Browne
*Attorney, Agent, or Firm*—Donald E. Nist

[57] ABSTRACT

The assembly includes a compound bow having a cable guard in the form of a plate secured to the bow handle and an arm extending rearwardly thereof to deflect laterally the pulley cables out of alignment with the arrow rest for improved arrow vane clearance. A cable slide guide bearing smooth, spaced cable-receiving side grooves is integrally or separately connected to the cable guard. A novel drawcheck is utilized wherein an indicator component thereof is a flexible clicker blade or a light assembly with switch, the switch arm of which is connected to and extends from the slide guide in the path of travel of an activator component thereof. The latter is a protuberance, such as a head, block, cylinder or the like secured to one of the cables. The activator component travels with the selected cable toward the indicator component as the bowstring is drawn and contacts and activates the indicator component when the bowstring is at full draw to turn on a light or cause an audible click by the blade on a tympanum near thereto. Arrow deflection by the clicker is thus avoided. The assembly provides improved shooting performance.

13 Claims, 7 Drawing Figures

COMPOUND ARCHERY BOW ASSEMBLY

BACKGROUND OF THE INVENTION

1. Field of the Invention

The present invention generally relates to archery equipment and more particularly to an improved compound archery bow assembly with novel cable slide guide and drawcheck.

2. Prior Art

Various so-called compound archery bows have become very popular because they provide gradual arrow acceleration and thus less arrow bending, thereby improving arrow speed and accuracy. Moreover, compound bows generally provide a mechanical advantage and allow the archer to hold at full draw at a lower draw weight than the maximum draw weight encountered during the draw. This also promotes improved shooting accuracy.

However, compound bows normally have two or more lengths of cable trained over limb cable wheels and spanning the length of the bow close to and about parallel to the bowstring. As the arrow is shot, its fletching may strike the cables, causing fletching wear and reducing arrow accuracy. In order to avoid this, some compound bow arrows have been fletched with very small flexible vanes. Such vanes are less than ideal in stabilizing arrow flight under certain shooting conditions.

A newer, more satisfactory solution to arrow vane wear has been to install a cable guard. Such a guard is usually connected to the bow handle and an arm thereof extends rearwardly and laterally to deflect the cables laterally out of the arrow's path. Unfortunately, the alignment of the cables with each other and passage by each other may be adversely affected and cable wear can occur where the guard intercepts them. Accordingly, there is a need to provide optimal cable alignment and minimal cable wear when a cable guard is used.

Most archers use drawchecks, usually of the audible clicker type, to indicate when they have reached full bowstring draw and thus enable them to have the bowstring apply the same propelling force to the arrow each time, thereby improving shooting accuracy. The drawchecks are usually secured to the arrow window in the bow handle section, and the arrow is fed between the flexible drawcheck blade and the bow sidewall defining the side of the window. When the arrow is drawn by the bowstring to full draw, its point just clears the rear of the drawcheck blade, which then springs against the bow sidewall and clicks, signalling time for the release of the bowstring, and the archer fires. Unfortunately, the drawcheck blade biases the arrow sideways under its spring tension until the blade is cleared, at which time the arrow tends to spring slightly laterally of the bow, shooting somewhat erratically and inaccurately, depending on the amount of time between the click and the bowstring release. This lateral spring is accentuated if the arrow while on the rest is, as is usually the case, spaced from the bow sidewall by a spring biased plunger. Accordingly, there is a need for an improved type of drawcheck which will not exert tension on the arrow and cause shooting inaccuracy.

SUMMARY OF THE INVENTION

The improved compound archery bow assembly of the present invention satisfies all the foregoing needs. The assembly is substantially as set forth in the Abstract above. Thus, it comprises a compound bow which includes a cable guard fitted with a cable slide guide to assure proper positioning of the cables and passage of the cables by each other and reduce wear to a minimum. It also includes an improved drawcheck which is completely out of contact with the arrow and therefore cannot interfere with its accurate flight. Instead, the drawcheck includes an indicator component connected to the cable slide guide or guard next to the guide and extending into the path traveled by an activator component fixed to one of the cables.

Thus, as the bowstring is drawn, the cables move. The activator is positioned on a cable so that it contacts and activates the indicator when the archer is at a preselected full draw. The indicator signals this with an audible click, preferably against a tympanum, or by a light coming on, such as may be mounted on the guard. In order to adjust the full draw position, at least one of the indicator and activator components is adjustable in position. Thus, for example, the indicator component can have a clicker blade which is adjustable in length. The activator component can have a block adjustably secured around the cable by a set screw, and/or having peelable or frangible segments to control its length and position.

Various other features of the present invention are set forth in the following detailed description and accompanying drawings.

DRAWINGS

DETAILED DESCRIPTION

FIGS. 1–5.

Figure 1:
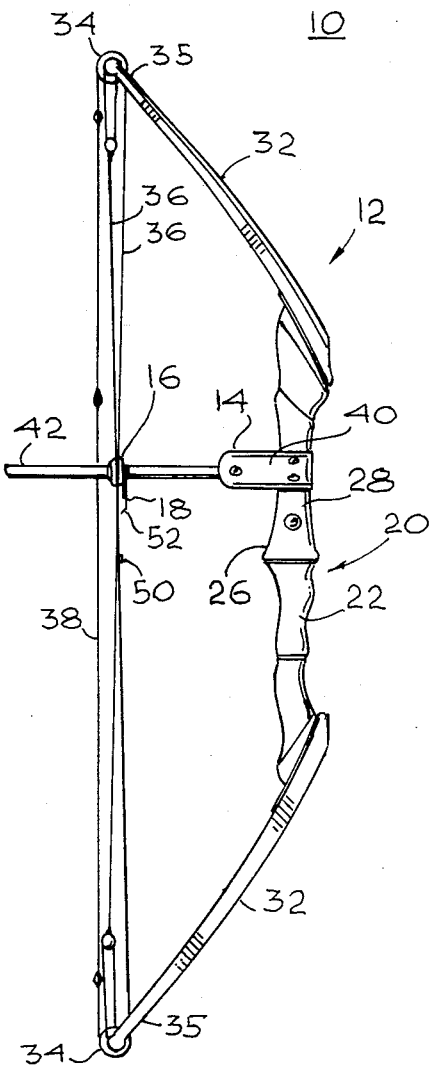
FIG. 1 is a schematic side elevation of a preferred embodiment of the improved compound archery bow assembly of the present invention.
Figure 2:
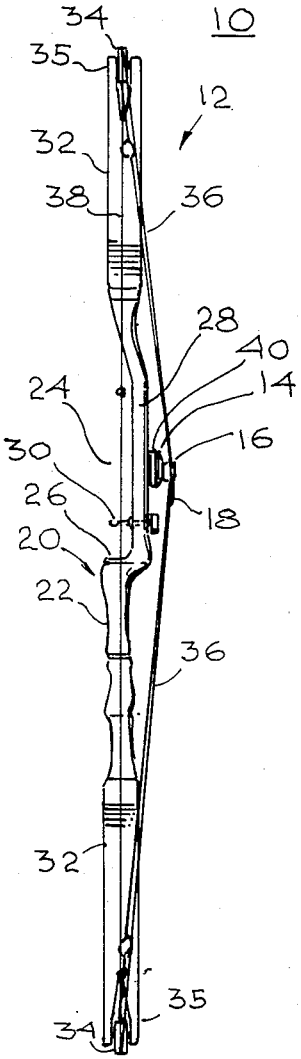
FIG. 2 is a schematic rear elevation of the assembly of FIG. 1.

Now referring more particularly to FIGS. 1 and 2 of the drawings, a preferred embodiment of the improved compound archery bow assembly of the present invention is schematically depicted therein. Thus, assembly 10 is shown which comprises a conventional compound archery bow 12, a cable guard 14 and a novel cable guide slide 16 and drawcheck 18.

Bow 12 may be in any suitable form. In this instance, it comprises a central metal or wood bow handle section 20 bearing a handle area 22 and an arrow window 24 defined by a horizontal shelf 26 and vertical sidewall 28. An arrow rest 30 is secured to sidewall 28 and extends into window 24 above shelf 26. Bow 12 also includes a pair of laminated composite bow limbs 32 secured to opposite ends of sections 20 and each rotatably bearing a cable wheel 34 at the tip 35 thereof.

Cable lengths 36 are trained around wheels 34 to provide bow 12 with a mechanical advantage, and span the length of bow 12. A bowstring 38 is secured to cables 36 adjacent tips 35, along about the longitudinal centerline thereof and is generally parallel to and spaced laterally from cables 36.

In order to provide adequate arrow vane clearance when an archer shoots an arrow (not shown) from rest 30 by bowstring 38, the plate portion 40 of cable guard 14 is secured, as by screws 41, to sidewall 28 on the side opposite window 24 and holds a generally horizontal rod arm 42 which extends rearwardly of string 38 (when in the resting state) and of cables 36.

Figure 4:
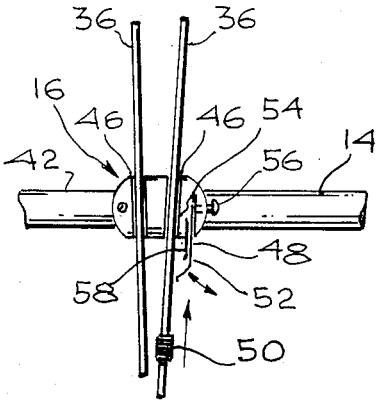
FIG. 4 is a further enlarged, fragmentary schematic side elevation, partly broken away, of the slide guide and drawcheck portions of the assembly of FIG. 1.

Rod arm 42 has cable slide guide 16 releasably secured to one side thereof, as by screws 44 (FIG. 4). Slide guide 16 bears two spaced generally vertical grooves 46, the exposed surfaces of which are polished very smooth or treated, as with a tetrafluoroethylene coating or the like, low friction material to minimize wear of cables 36. Grooves 46 are oriented to properly guide cables 36 past each other in proper orientation, even though guard 14 and guide 16 deflect cables 26 substantially laterally from bowstring 38 (FIG. 2) for proper arrow vane clearance. This assures proper functioning of bow 12.

Figure 5:
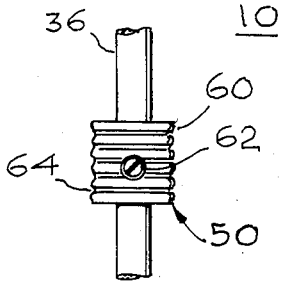
FIG. 5 is a greatly enlarged schematic side elevation of the activator portion of the drawcheck of FIG. 1.
Figure 3:
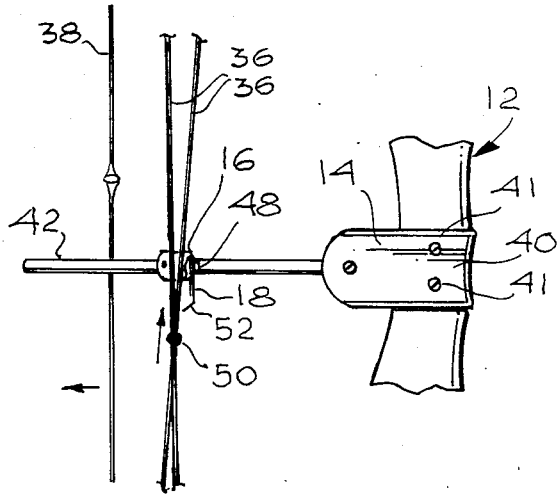
FIG. 3 is an enlarged, fragmentary schematic side elevation of the arm guard, slide guide and drawcheck poritons of the assembly of FIG. 1.

Drawcheck 18 comprises an indicator portion 48 adjustably secured to guide 16 and an activator portion 50 adjustably secured to one of cables 36 (FIGS. 3, 4 and 5). Indicator portion 48 comprises an elongated flexible resilient blade 52 of metal or the like adjustably secured in grooves 54 of guide 16 by set screw 56, and a tympanum plate 58 positioned behind blade 52 and also secured to guide 16 or blade 52.

Blade 52 faces, is in the path of travel of and is adapted to intercept activator 50 as bowstring 38 is pulled back to a preselected full draw position. Activator 50 during such travel thus causes blade 52 to first flex laterally and then snap back and strike against tympanum 58, making a loud click to signal the archer to release the bowstring.

Activator 50 comprises a protuberance or block 60 which extends laterally from cable 36 to which it is releasable connected, as by set screw 62. Block 60 can be, for example, tubular with a central opening and can be threaded on cable 16, or can be two overlapping semi-cylindrical shells, etc. secured by screw 62. Alternatively, block 60 can be fixed in place with adhesive, glue, plastic, etc. Block 60 preferably has parallel score lines 64 and is of frangible wood, plastic or the like so it can also be adjusted in length by breaking segments off along score lines 64. Thus, block 60's resting position relative to blade 52 can be controlled to control when clicking occurs to signal full draw.

It will be understood that activator 50 is connected to a cable 36 on the side thereof which travels toward guide 16 during drawing, and that blade 52 faces toward activator 50.Therefore block 60 could be above guide 16 on the appropriate cable 36. Guide 16 could be integral with guard arm 42. Indicator 48 could also be connected directly to arm 42 at or very near guide 16, if desired.

Accordingly, assembly 10 is fully adjustable as to full draw position, with check 18 causing no deflection of an arrow during shooting from bow 12. Moreover, guide 16 assures proper cable alignment and functioning with minimal cable wear. Guide 16 and check 18 are inexpensive, durable and easy to install.

FIG. 6.

Figure 6:
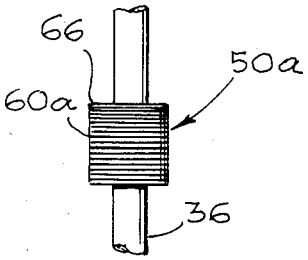
FIG. 6 is a greatly enlarged schematic side elevation of a modified form of the activator portion of the drawcheck of the present invention; and, FIG. 7 is an enlarged, fragmentary schematic rear elevation, partly broken away and partly in section, of an alternate form of the indicator portion of the drawcheck of the present invention.

A modified form of the activator portion of the draw check of the present invention is shown in FIG. 6. Thus, activator **50*a* is shown which comprises block 60*a* fixable in place on cable 36, as by glue, etc. The length and therefore the position of block 60*a* on cable 36 can be adjusted to adjust the draw length necessary to effect clicking, merely by peeling thin-transverse layers 66 from the leading end thereof. Block 60*a* is preferably tubular and formed of many thin discs of paper, foil or plastic glued in stacked relation and is mounted by threading it on cable 36. Alternatively, block 60*a* can have a longitudinal opening (not shown) through which cable 36 can be forced into the center of block 60*a*, after which gluing together of block 60*a* and cable 36** takes place.

FIG. 7.

Figure 7:
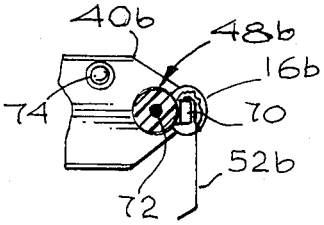

An alternate form of the indicator portion of the drawcheck of the present invention is schematically depicted in FIG. 7. Thus, indicator **48*b* is shown which includes a blade-like switch arm 52*b* depending from slide guide 16*b* secured to arm 42*b* of guard 14*b*. Switch arm 52*b* is connected to switch 70 in guide 16*b*. Electrical conduits 72 extend through arm 42*b* and connect switch 70 with battery powered (by dry cell or the like) light 74 (lamp or L.E.D.) secured to plate 40*b* of guard 14*b*** and extending rearwardly therefrom for viewing by an archer.

In the resting position shown for arm **52*b* in FIG. 7, light 74 is off. However, when arm 52*b* is deflected laterally in the direction of the arrow, as by contact with activator 50 or 50*a*, light 74 goes on and the archer is signaled visually to fire the bowstring. Thus, indicator 48*b* can be substituted for indicator 48**.

Various other modifications, changes, alterations and additions can be made in the improved compound bow assembly of the present invention, its components and parameters. All such modifications, changes, alterations and additions as are within the scope of the appended claims form part of the present invention.

What is claimed is:

1. A compound archery bow assembly comprising, in combination:

a. a compound archery bow having
   i. a pair of spaced bow limbs at opposite ends thereof,
   ii. a handle with an arrow rest on one side thereof, said handle interconnecting said bow limbs,
   iii. pulleys connected to said limbs,
   iv. pulley cables trained around said pulleys and spanning said bow and,
   v. a bowstring connected to said cables;

b. a cable guard secured to said handle and deflecting said cables laterally out of alignment with said rest to increase arrow vane clearance;

c. a cable slide guide connected to said cable guard and guiding said cables around said guard; and, d. an arrow drawcheck comprising
   i. an activator component means for actuating a device to indicate to a user that the bowstring is at a proper draw, said activator component means being releasably connected to one of said bow cables adjacent said slide guide, said one of said cables being movable generally in a path toward said slide guide and toward at least one of said bow links during drawing of said bowstring, bearing said activator component with it and ii. a drawcheck indicator component means connected to said slide guide and activatable by contact with said activator component to indicate to a user a predetermined full draw position of said bowstring.

2. The improved archery bow assembly of claim 1 wherein said activator component comprises a protuberance extending form said one of said cables to which it is connected and wherein said indicator component comprises a flexible clicker blade connected to said slide guide.

3. The improved archery bow assembly of claim 2 wherein said indicator component includes a tympanum positioned adjacent said blade and which audibly clicks when struck by said blade.

4. The improved archery bow assembly of claim 2 wherein said blade is adjustable in length.

5. The improved archery bow assembly of claim 1 wherein said activator component comprises a protuberance extending from said cable to which it is connected, and wherein said indicator component comprises a switch arm extending from said slide guide in said path of said protuberance, a switch in said slide guide, a battery powered light connected to the exterior of one of said slide guide and cable guard and electrical conduits interconnecting said switch and light.

6. The improved archery bow assembly of claim 1 wherein said activator component comprises a block secured to said one of said cables and adjustable in position thereon.

7. The improved archery bow assembly of claim 6 wherein said block extends around said cable and is releasably secured thereto by a screw.

8. The improved archery bow assembly of claim 6 wherein said block comprises a tube anchored around said cable and having readily frangible transverse segments for adjusting the length of said tube.

9. The improved archery bow assembly of claim 6 wherein said block comprises a cylinder anchored around said one of said cables and including peelable components for reducing the length thereof.

10. The improved archery bow assembly of claim 1 wherein there are two of said pulley cables, wherein said cable guard comprises a plate mounted on said handle and an arm extending rearwardly and laterally therefrom and wherein said slide guide comprises a body which includes a pair of spaced cable guide grooves with exposed surfaces in one side thereof, said guide being releasably secured to said cable guard arm.

11. The improved archery bow assembly of claim 10 wherein the exposed surface of said grooves comprises low friction material.

12. The improved archery bow assembly of claim 1 wherein said cable guard comprises a plate mounted on said handle and an arm extending rearwardly therefrom and wherein said slide guide is integral with said arm and includes spaced cable-receiving grooves in one side thereof.

13. The improved archery bow assembly of claim 12 wherein the exposed surface of said grooves comprises low friction material.

* * * * *